US009404276B2

(12) United States Patent
Geelen

(10) Patent No.: US 9,404,276 B2
(45) Date of Patent: Aug. 2, 2016

(54) AID FOR LAYING FLOORING TILES

(71) Applicant: T1 PRODUCTS, LM Herten (NL)

(72) Inventor: Antoon Laurens Gerard Marie Geelen, Herten (NL)

(73) Assignee: T1 PRODUCTS, LM Herten (NL)

( * ) Notice: Subject to any disclaimer, the term of this patent is extended or adjusted under 35 U.S.C. 154(b) by 0 days.

(21) Appl. No.: 14/397,321

(22) PCT Filed: Apr. 26, 2013

(86) PCT No.: PCT/NL2013/050318

§ 371 (c)(1),
(2) Date: Oct. 27, 2014

(87) PCT Pub. No.: WO2013/162370

PCT Pub. Date: Oct. 31, 2013

(65) Prior Publication Data

US 2015/0143776 A1 May 28, 2015

(30) Foreign Application Priority Data

Apr. 26, 2012 (NL) ..... 2008711

(51) Int. Cl.
*E04F 21/00* (2006.01)
*E04G 21/16* (2006.01)
*E04F 21/22* (2006.01)

(52) U.S. Cl.
CPC ..... *E04G 21/165* (2013.01); *E04F 21/22* (2013.01)

(58) Field of Classification Search
CPC ..... E04F 21/20; E04F 21/22; E04G 21/165
USPC ..... 52/748.11, DIG. 1; 33/527
See application file for complete search history.

(56) References Cited

U.S. PATENT DOCUMENTS

| | | | | |
|---|---|---|---|---|
| 2,642,674 | A * | 6/1953 | Schell, Jr. | 33/527 |
| 4,091,945 | A * | 5/1978 | Patterson | 414/416.07 |
| 5,832,619 | A * | 11/1998 | Volkema, Jr. | 33/527 |
| 5,862,644 | A | 1/1999 | Jones | |
| 6,796,049 | B1 | 9/2004 | Claxton | |
| 2004/0250435 | A1 * | 12/2004 | Fiore | 33/527 |

FOREIGN PATENT DOCUMENTS

| | | |
|---|---|---|
| FR | 2782739 A1 | 3/2000 |
| FR | 2851599 A1 | 8/2004 |

OTHER PUBLICATIONS

International Search Report PCT/NL2013/050318 dated Sep. 16, 2013.

* cited by examiner

*Primary Examiner* — Adriana Figueroa
(74) *Attorney, Agent, or Firm* — Shumaker, Loop & Kendrick, LLP

(57) ABSTRACT

An aid for laying floor tiles on an adhesive bed applied to a floor surface including a support handle having a first and second end, as well as a supporting surface provided at each end, wherein each supporting surface can be supported on the floor surface and wherein each supporting surface is provided with several projections spaced apart such that a support is realized by means of which the tiler can be supported on the floor surface while carrying out work, so that the occurrence of injuries and other physical discomfort can be reduced as much as possible, and wherein furthermore undesirable disturbance of or damage to the adhesive bed on which the flooring tiles are to be placed is prevented.

10 Claims, 5 Drawing Sheets

AID FOR LAYING FLOORING TILES

The invention relates to an aid for laying flooring tiles on an adhesive bed applied to a floor surface.

Laying flooring tiles is physically demanding work, which imposes a heavy burden on a person's back and upper and lower limbs. More specifically, a tiler's job is characterised by work carried out in uncomfortable postures for prolonged periods of time and by activities, such as heavy lifting, pushing and pulling that may lead to injury and other physical discomfort.

BRIEF SUMMARY OF THE INVENTION

The object of the present invention is to provide an aid which provides sufficient support for the tiler when carrying out work close to the ground, so that undesirable and uncomfortable loads on the tiler's back and limb are prevented as much as possible.

According to the invention, the aid is to that end characterised in that it comprises a support handle having a first and a second end, as well as a supporting surface provided at each end, wherein each supporting surface can be supported on the floor surface and wherein each supporting surface is provided with several projections spaced some distance apart.

In this way a support is realised by means of which the tiler can be supported on the floor surface while carrying out work, so that the occurrence of injuries and other physical discomfort can be reduced as much as possible, and wherein furthermore undesirable disturbance of or damage to the adhesive bed on which the flooring tiles are to be placed is prevented.

According to another aspect of the invention, each supporting surface is provided with at least four projections, which projections are disposed near each of the corner points of the supporting surface. In this way an efficient distribution of forces is realised whilst the adhesive bed is disturbed as little as possible.

In another functional embodiment, the projections are spaced so far apart on the supporting surface that when the aid is placed on the floor surface, each projection can be placed between adjacent adhesive ridges formed in the adhesive bed by means of a notch trowel. In this way disturbance of the adhesive bed is prevented, whilst an adequate support of the tiler during his or her work is ensured. This, too, is aimed at preventing physical discomfort, such as back and limb injuries, as much as possible.

According to a functional aspect, the thickness of each projection at most equals the spacing between two adjacent adhesive ridges. The use of projections having a thickness or width that at most equals the spacing between two adjacent adhesive ridges on the one hand provides a sufficiently stable and ergonomic support for the tiler and on the other hand ensures that the adhesive bed will be disturbed as little as possible.

According to another functional embodiment, the aid is characterised in that each supporting surface can be detached from the handle. This makes it possible to repair the aid, for example in the case of damaged supporting surfaces and/or broken projections, which prolongs the life of the aid and which, in addition, makes it readily possible to adapt the aid to the adhesive bed and in particular to the shape or dimension of the adhesive ridges formed in the adhesive bed by means of a notch trowel.

According to a special aspect, the aid is characterised in that each end of the handle and each supporting surface are provided with mating snap connectors.

BRIEF DESCRIPTION OF THE DRAWINGS

The invention will now be explained with reference to a drawing, in which.

DETAILED DESCRIPTION OF THE INVENTION

For a better understanding of the invention, identical parts will be indicated by the same numerals in the following description of the figures.

Figure 1:
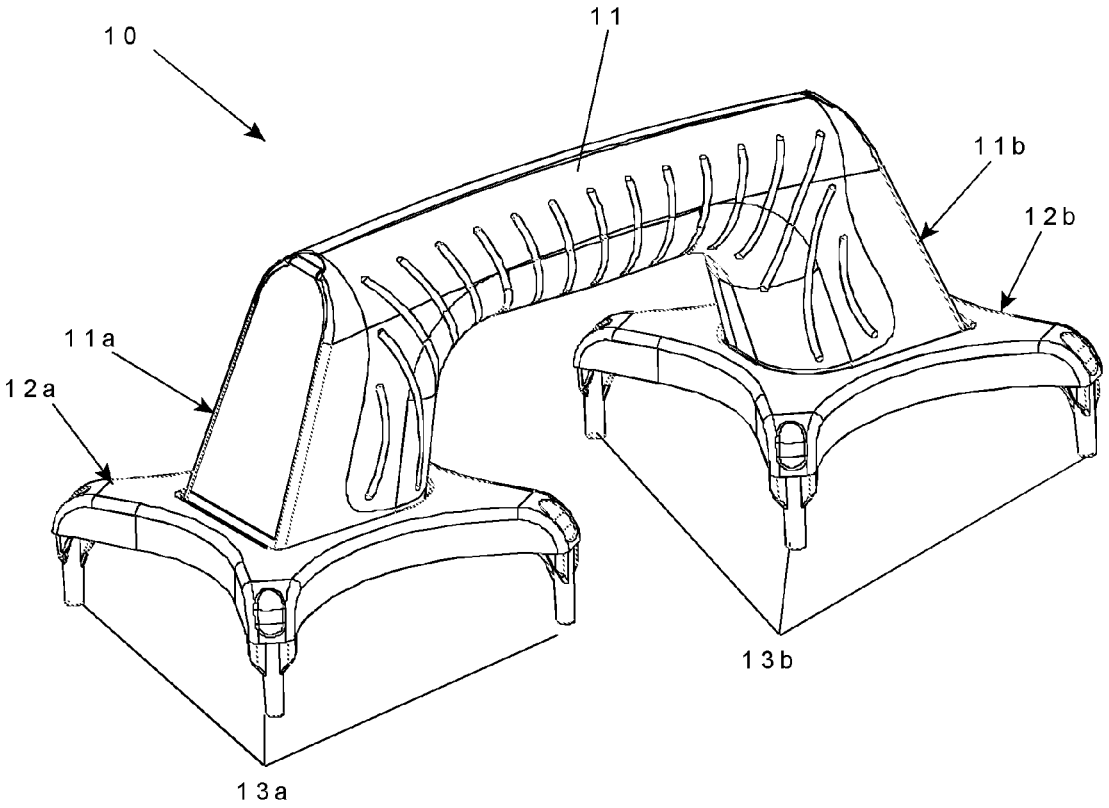
FIG. 1 shows a first embodiment of an aid according to the invention.

Numeral 10 in FIG. 1 shows a non-limitative embodiment of an aid according to the invention. The aid 10 is made up of a handle 11 having a first and a second end 11*a*-11*b*. Each end 11*a*-11*b* is provided with a supporting surface 12*a*, 12*b*, respectively, which is detachably connected to the respective end 11*a*-11*b*, in a manner yet to be described hereinafter.

Figure 2:
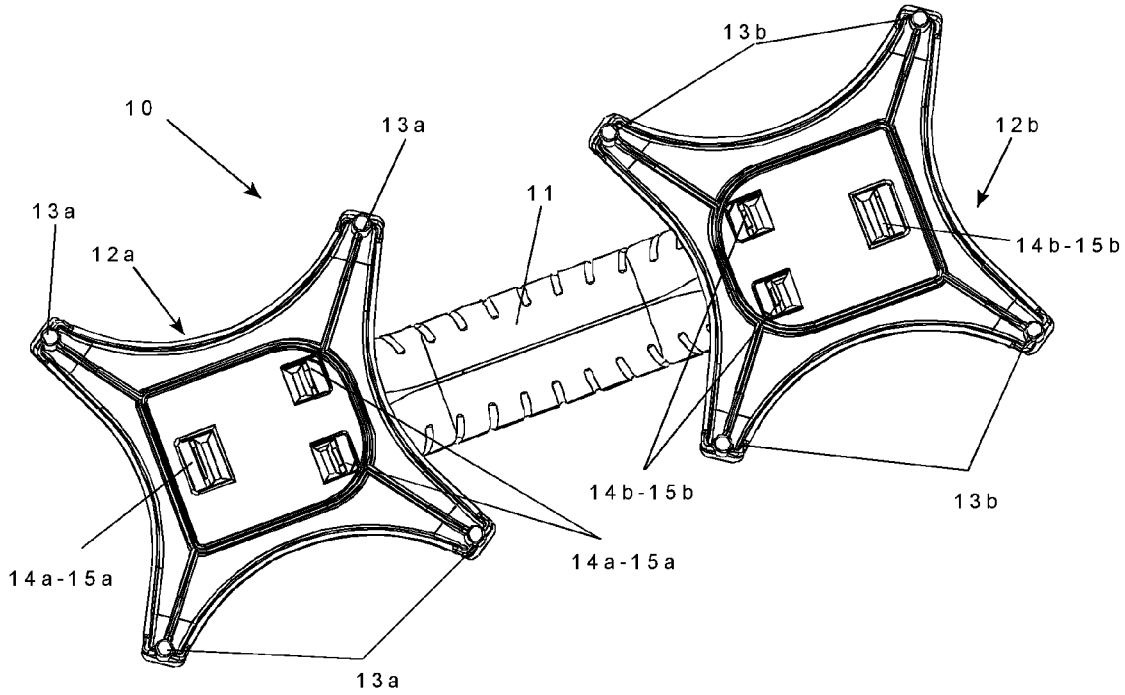
FIG. 2 shows a bottom view of FIG. 1.

As FIG. 2 shows, each supporting surface 12*a*-12*b* has a substantially symmetrical square shape, being provided with a projection 13*a*, 13*b*, respectively, near each corner point.

During use of the aid 10, the aid must be placed on the adhesive bed that has been applied to a floor surface on which flooring tiles are to be placed. The aid is supported on the floor via its projections 13*a*-13*b*, which projections 13*a*-13*b* are placed in the adhesive bed.

More specifically, the cams are so configured as regards their mutual spacing and thickness that when the aid is placed in the adhesive bed, the projections can be placed between adjacent adhesive ridges formed in the adhesive bed by means of a notch trowel. More in particular, each projection 13*a*-13*b* has a thickness which at most equals the spacing between two adjacent adhesive ridges.

In this way it is ensured that the adhesive bed will be disturbed as little as possible, so that the placement and bonding of the flooring tiles will be affected to a minimum extent.

In one embodiment, the projections 13*a*-13*b* have a length of about 10 mm, and the spacing between the projections (in particular the smallest spacing) is about 90-100 mm.

Preferably, the supporting surfaces 12*a*-12*b* can be detached from the ends 11*a*-11*b* of the handle 11.

The first end and the second end 11*a*-11*b* as well as each supporting surface 12*a*-12*b* are to that end provided with mating snap connectors 14*a*-15*a* and 14*b*-15*b*, respectively.

Figure 3:
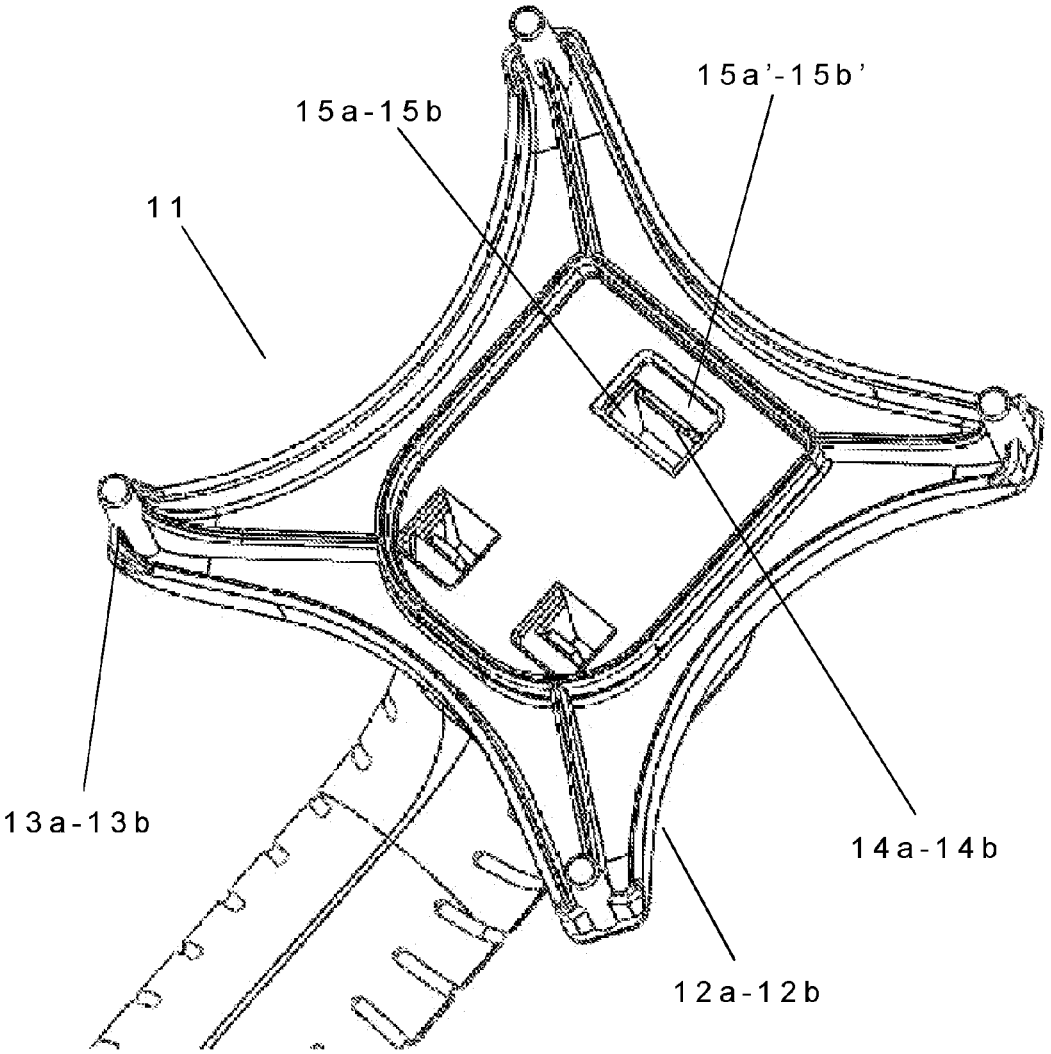
FIG. 3 shows a detail view of FIG. 2.

As FIG. 3 shows, each supporting surface 12*a*-12*b* is provided with several (three in FIG. 2) openings 15*a*-15*b* provided with a clamp-snap edge 15*a*'-15*b*'. Each first and second end 11*a*-11*b* is provided with spring projections or pins, which are preferably flat and which can be received in the openings 15*a*-15*b* of each supporting surface. The spring projections or pins 14*a*-14*b* to that end engage behind the clamping edge 15*a*'-15*b*' of each opening 15*a*-15*b*, so that they are clampingly retained therein.

In this way a strong yet non-permanent connection can be realised between the handle and the supporting surface, making it possible to exchange the supporting surface, for example when a supporting surface is damaged or when the aid 10 is to be adjusted to suit a different shape and dimension of the adhesive bed realised by means of a notch trowel.

Figure 4:
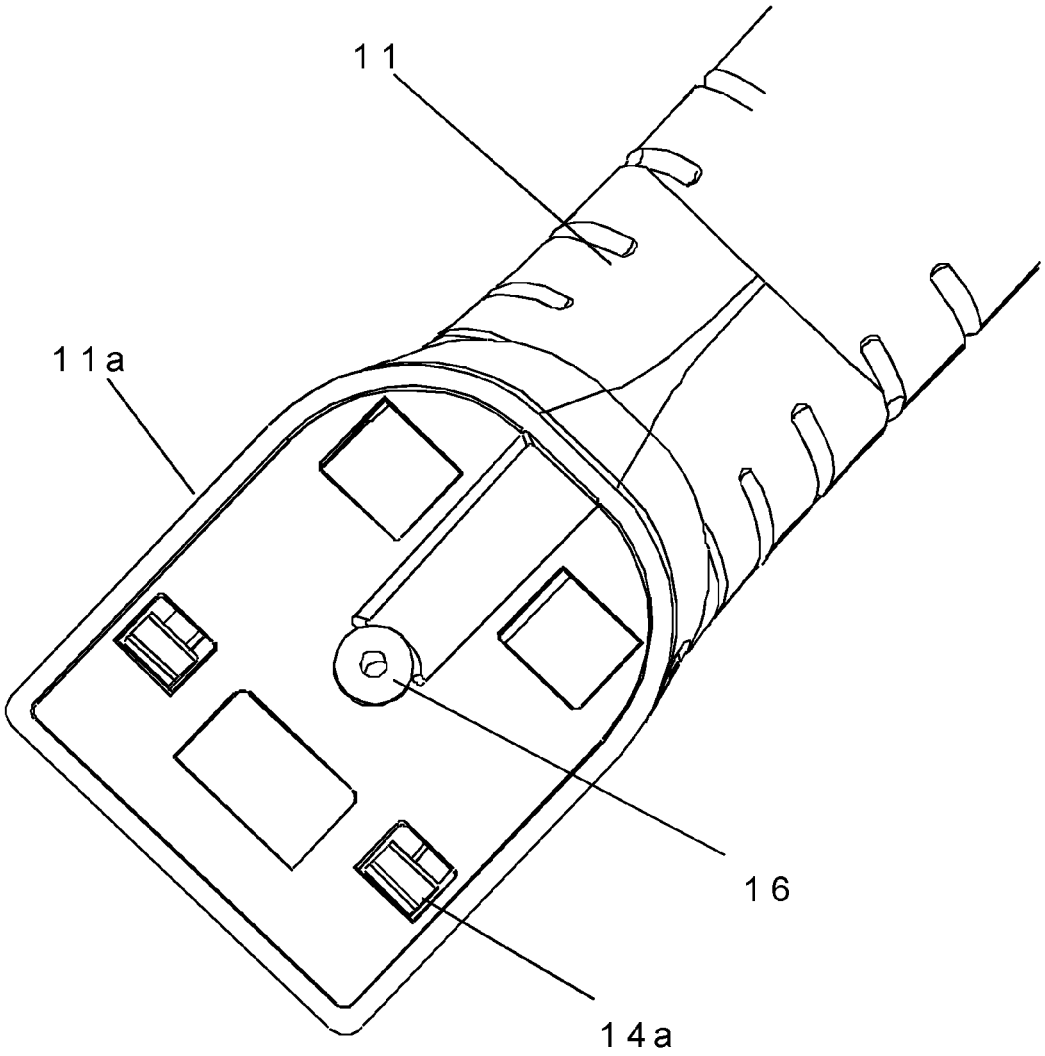
FIG. 4 shows another detail of an embodiment.

In another embodiment, the detachable supporting surfaces can be connected to the support by means of a screw, in particular a self-tapping screw. The support is to that end provided with a through bore 16 near each end 11*a*-11*b* (see FIG. 4), in which the screw, which may or may not be a self-tapping screw, can be received, with the screw engaging the supporting surface 12*a*-12*b*.

Instead of a supporting surface provided with projections, another part can be connected to the support 12, for example a cement or mortar trowel for levelling large surfaces.

Figure 5:
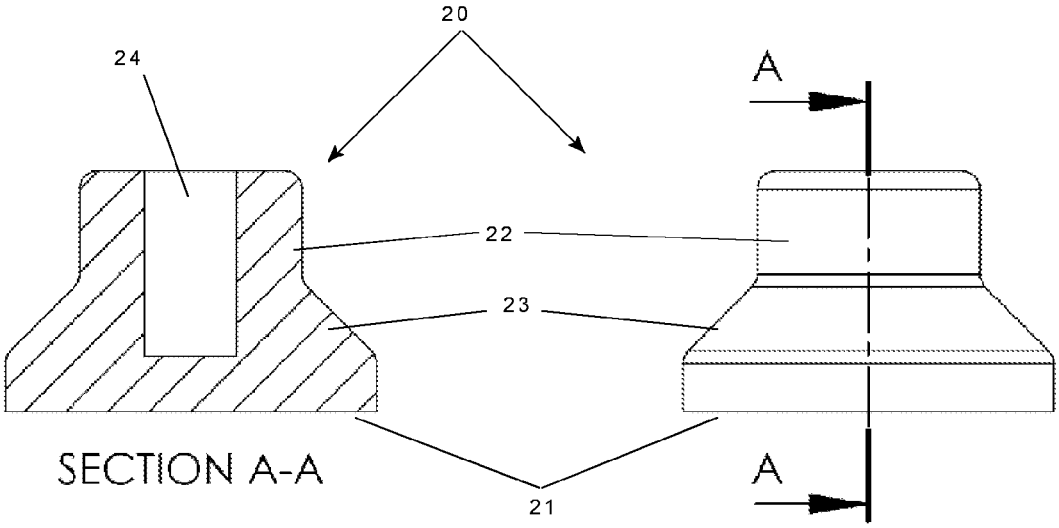
FIG. 5 shows another detail of an embodiment.

FIG. 5 shows another detail of an embodiment for use with an aid 10 according to the invention. Numeral 20 discloses a support cap that can be placed over the projections 13*a*-13*b*. The cap 20 is to that end provided with an opening 24, whose internal dimension (diameter) is equal to or slightly smaller than the external dimension (diameter) of the projections 13*a*-13*b*. The cap is preferably cylindrical in shape and has a supporting surface 21 which is wider than the "neck" 22 of the cap. The narrower neck 22 blends into the wide supporting surface 21.

The support cap 20 may be made of a plastic material, in particular a rubber. The support cap 20 is used in combination with the tool after tiles have been placed on an adhesive bed and in particular upon jointing of the tiles after laying. To prevent the aid 10 from slipping away during this finishing operation of the tiled floor, support caps 20 can be placed over the projections 13*a*-13*b*, so that additional friction with the, usually slippery, tile surface is obtained.

The supporting surface 21 may be roughened or be provided with small unevennesses, which friction-increasing means have a friction-increasing effect.

It will be understood that the present invention provides an aid by means of which tilers can carry out their work with a minimum physical burden and minimal physical problems, thereby preventing the risk of impeding or permanent back or limb damage.

The invention claimed is:

1. A tiler support aid for supporting a tiler when laying flooring tiles on an adhesive bed applied to a floor surface, comprising:

a U-shaped support handle having a first end and a second end pointing in a direction of the floor surface when the tiler support aid is in use; and a first supporting member directly connected to the first end and the second supporting member directly connected to the second end, wherein the first and the second supporting members are spaced from one another, and wherein each of the first and second supporting members is adapted to be supported on the floor surface, wherein each of the first and second supporting members is provided with a plurality of spaced projections spaced a predetermined distance apart such that when the tiler support aid is placed on the floor surface, each of the spaced projections is dimensioned to fit between adjacent adhesive ridges formed in the adhesive bed by a notched trowel, the U-shaped support handle adapted to distribute forces towards the floor surface.

2. The tiler support aid according to claim 1, wherein each of the first and second supporting members includes at least four of the spaced projections, wherein the spaced projections are positioned near each corner of the respective first or second supporting member.

3. The tiler support aid according to claim 1, wherein a thickness of each spaced projection at most equals spacing between two adjacent adhesive ridges.

4. The tiler support aid according to claim 1, wherein each of the first and second supporting members is adapted to be detached from the handle.

5. The tiler support aid according to claim 4, wherein each of the first and second ends of the handle and each of the first and second supporting members are configured with mating snap connectors.

6. The tiler support aid according to claim 4, wherein each of the first and second ends of the support handle include a through bore for receiving a screw adapted to engage in one of the first and second supporting members.

7. The tiler support aid according to claim 1, further comprising a support cap adapted to be placed over each spaced projection.

8. The tiler support aid according to claim 7, wherein each of the support caps is provided with a recess for receiving a respective one of the spaced projections therein.

9. The tiler support aid according to claim 7, wherein a supporting surface of each of the support caps includes friction-increasing means.

10. The tiler support aid according to claim 1, wherein each of the spaced projections is circular and has an outer diameter less than a distance between the adjacent adhesive ridges.

* * * * *